US010160620B2

(12) United States Patent
Mosher et al.

(10) Patent No.: US 10,160,620 B2
(45) Date of Patent: Dec. 25, 2018

(54) TENSION MEMBER FOR ELEVATOR SYSTEM

(71) Applicant: Otis Elevator Company, Farmington, CT (US)

(72) Inventors: Daniel A. Mosher, Glastonbury, CT (US); Richard N. Fargo, Plainville, CT (US); John P. Wesson, West Hartford, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/541,658

(22) PCT Filed: Jan. 8, 2016

(86) PCT No.: PCT/US2016/012628
§ 371 (c)(1),
(2) Date: Jul. 5, 2017

(87) PCT Pub. No.: WO2016/112277
PCT Pub. Date: Jul. 14, 2016

(65) Prior Publication Data

US 2018/0022578 A1 Jan. 25, 2018

Related U.S. Application Data

(60) Provisional application No. 62/101,502, filed on Jan. 9, 2015.

(51) Int. Cl.
*B66B 7/06* (2006.01)
*D07B 5/00* (2006.01)
(Continued)

(52) U.S. Cl.
CPC ..... *B66B 7/062* (2013.01); *B66B 9/00* (2013.01); *D07B 5/005* (2013.01); *D07B 1/22* (2013.01);
(Continued)

(58) Field of Classification Search
CPC ..... B66B 7/062; B66B 9/00
See application file for complete search history.

(56) References Cited

U.S. PATENT DOCUMENTS 2,010,894 A 8/1935 Repony et al.
3,802,478 A 4/1974 Boustany et al.
(Continued)

FOREIGN PATENT DOCUMENTS

DE 3813338 A1 11/1989
EP 0429299 A2 5/1991
(Continued)

OTHER PUBLICATIONS

PCT International Search Report ISR; International Application No. PCT/US2016/012628; International Filing Date: Jan. 8, 2016; dated May 9, 2016; pp. 1-6.
(Continued)

*Primary Examiner* — Michael A Riegelman
(74) *Attorney, Agent, or Firm* — Cantor Colburn LLP

(57) ABSTRACT

A load bearing member is provided including at least one load bearing segment having a plurality of load carrying fibers arranged within a matrix material. At least a portion of the load bearing member has a radius of curvature when the load bearing member is untensioned.

17 Claims, 5 Drawing Sheets

(51) Int. Cl.
*B66B 9/00* (2006.01)
*D07B 1/22* (2006.01)

(52) U.S. Cl.
CPC ..... *D07B 2201/1004* (2013.01); *D07B 2205/205* (2013.01); *D07B 2205/2046* (2013.01); *D07B 2205/3003* (2013.01); *D07B 2205/3007* (2013.01); *D07B 2501/2007* (2013.01)

(56) References Cited

U.S. PATENT DOCUMENTS 6,364,063 B1 * 4/2002 Aulanko ..... B66B 11/008 187/251
7,137,483 B2 11/2006 Kato et al.
7,296,394 B2 11/2007 Clough et al.
7,594,642 B2 9/2009 Curchod
7,858,180 B2 12/2010 Bhatnagar et al.
8,673,433 B2 3/2014 Reif et al.
8,807,286 B2 * 8/2014 Puranen ..... B66B 5/0018 187/391
9,790,054 B2 * 10/2017 Alasentie ..... B66B 7/062
9,856,113 B2 * 1/2018 Lehtinen ..... B66B 7/06
2011/0000746 A1 * 1/2011 Pelto-Huikko ..... B66B 7/062 187/254
2012/0325590 A1 * 12/2012 Valjus ..... B66B 5/04 187/251
2013/0048432 A1 * 2/2013 Alasentie ..... B66B 7/068 187/251
2014/0004298 A1 * 1/2014 Reif ..... B29D 29/00 428/113
2014/0182975 A1 * 7/2014 Ikonen ..... B66B 5/0031 187/251
2014/0305744 A1 * 10/2014 Kere ..... B66B 7/1238 187/254
2014/0305745 A1 * 10/2014 Alasentie ..... B66B 7/062 187/266
2014/0318902 A1 * 10/2014 Pelto-Huikko ..... B66B 7/062 187/251
2015/0060588 A1 * 3/2015 Lehtinen ..... B65H 75/16 242/407
2015/0362450 A1 * 12/2015 Lehtinen ..... B66B 19/02 187/391
2016/0060077 A1 * 3/2016 Haapaniemi ..... B66B 9/00 187/255
2017/0057788 A1 * 3/2017 Helenius ..... B66B 1/30
2017/0217729 A1 * 8/2017 Lehtinen ..... B66B 7/062

FOREIGN PATENT DOCUMENTS

EP 2020398 A1 2/2009
GB 1401197 A 7/1975
WO 2009090299 A1 7/2009
WO 2011135174 A1 11/2011
WO 2012120144 A2 9/2012
WO 2013110853 A1 8/2013
WO 2013140038 A1 9/2013
WO 2013144844 A1 10/2013

OTHER PUBLICATIONS

PCT ISR Written Opinion; International Application No. PCT/US2016/012628; International Filing Date: Jan. 8, 2016; dated May 9, 2016; pp. 1-6.

* cited by examiner

TENSION MEMBER FOR ELEVATOR SYSTEM

CROSS REFERENCE TO RELATED APPLICATIONS

This application is a National Stage application of PCT/US2016/012628, filed Jan. 8, 2016, which claims the benefit of U.S. Provisional Application No. 62/101,502, filed Jan. 9, 2015, both of which are incorporated by reference in their entirety herein.

BACKGROUND OF THE INVENTION

Embodiments of the invention relate to elevator systems, and more particularly, to a load bearing member having a high bending stiffness configured for use in an elevator system.

Elevator systems are useful for carrying passengers, cargo, or both, between various levels in a building. Some elevators are traction based and utilize load bearing tension members such as ropes or belts for supporting the elevator car and achieving the desired movement and positioning of the elevator car.

Where ropes are used as tension members, each individual rope is not only a traction device for transmitting the pulling forces but also participates directly in the transmission of the traction forces. Where belts are used as a tension member, a plurality of adjacent ropes configured as tension members are embedded in a common elastomer belt body. The tension members are exclusively responsible for transmitting the pulling forces, while the elastomer material transmits the traction forces. The belt as a traction device, especially the elastomer region between the tension members and the contact surface, is thus exposed to high shear and shearing stresses during operation.

Due to their light weight and high strength, load bearing traction members formed from unidirectional fibers arranged in a rigid matrix composite provide significant benefits when used in elevator systems, particularly high rise systems. However, the unidirectional composite construction results in a high bending stiffness which can produce substantial bending stress when used in an elevator system where the load bearing member is wrapped around a traction sheave. While the bending stresses may be reduced by decreasing the thickness of the load bearing member, the width must be increased to achieve a load bearing member having the same load carrying capacity. As a result of the space constraints for most elevators systems, such an increase in the width of the load bearing members may exceed the space available for the drive machine within the hoistway.

BRIEF DESCRIPTION OF THE INVENTION

According to one embodiment of the invention, a load bearing member is provided including a load bearing segment having a plurality of load carrying fibers arranged within a matrix material. At least a portion of the load bearing member has a radius of curvature when the load bearing member is untensioned.

In addition to one or more of the features described above, or as an alternative, in further embodiments the plurality of load carrying fibers have a unidirectional orientation.

In addition to one or more of the features described above, or as an alternative, in further embodiments the plurality of load carrying fibers are substantially identical.

In addition to one or more of the features described above, or as an alternative, in further embodiments the plurality of load carrying fibers arranged at an outer portion of the radius of curvature have a longer untensioned length than a plurality of load bearing fibers arranged adjacent an inside of the radius of curvature.

In addition to one or more of the features described above, or as an alternative, in further embodiments the at least one load bearing segment is formed as a pultrusion.

In addition to one or more of the features described above, or as an alternative, in further embodiments the load bearing member includes a plurality of load bearing segments spaced apart from one another by a distance.

In addition to one or more of the features described above, or as an alternative, in further embodiments each of the plurality of load bearing segments is substantially identical.

In addition to one or more of the features described above, or as an alternative, in further embodiments a coating layer surrounds at least a portion of the load bearing pultrusions and defines an engagement surface of the load bearing member.

According to another embodiment of the invention, an elevator system is provided including a hoistway. A drive machine mounted within the hoistway has a traction sheave coupled thereto. An elevator car and a counterweight are movable within the hoistway. One or more load bearing members connect the elevator car and the counterweight. The load bearing member is arranged in contact with the traction sheave such that operation of the drive machine moves the elevator car between a plurality of landings. Each of the one or more load bearing members includes one or more load bearing segments, each having a plurality of load carrying fibers arranged within a matrix material. At least a portion of the one or more load bearing members has a radius of curvature when the load bearing member is untensioned.

In addition to one or more of the features described above, or as an alternative, in further embodiments the traction sheave has a diameter between about 150 and 300 times a thickness of the load bearing member.

In addition to one or more of the features described above, or as an alternative, in further embodiments the plurality of load carrying fibers have a unidirectional orientation.

In addition to one or more of the features described above, or as an alternative, in further embodiments an untensioned length of the plurality of load carrying fibers arranged within the portion of the load bearing member having a radius of curvature varies.

In addition to one or more of the features described above, or as an alternative, in further embodiments the plurality of load carrying fibers arranged adjacent an inner bend radius have a first untensioned length and the plurality of load carrying fibers arranged adjacent an outer bend radius have a second untensioned length. The first untensioned length is shorter than the second untensioned length.

In addition to one or more of the features described above, or as an alternative, in further embodiments the at least one load bearing segment is formed as a pultrusion.

In addition to one or more of the features described above, or as an alternative, in further embodiments the load bearing member includes a plurality of load bearing segments spaced apart from one another by a distance.

In addition to one or more of the features described above, or as an alternative, in further embodiments each of the plurality of load bearing segments is substantially identical.

In addition to one or more of the features described above, or as an alternative, in further embodiments the load bearing member includes a coating layer surrounding a portion of the at least one load bearing segment, the coating layer defining an engagement surface configured to contact the traction sheave.

In addition to one or more of the features described above, or as an alternative, in further embodiments the curvature of the load bearing member when untensioned has a diameter between about 1.5 to about 2.5 times the diameter of the traction sheave.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
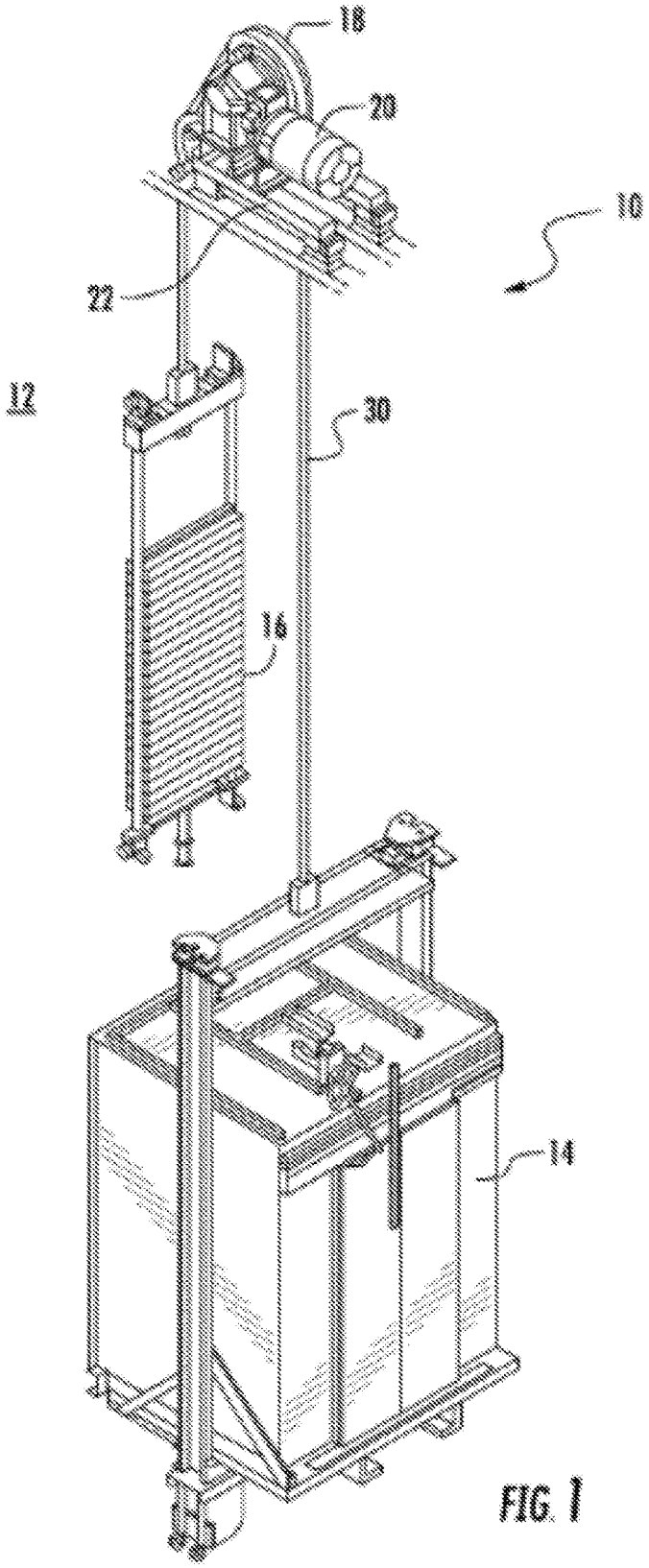
FIG. 1 is a perspective view of an example of a traction elevator system.

Referring now to FIG. 1, an example of elevator system 10 according to an embodiment of the invention is illustrated. The elevator system 10 includes an elevator car 14 configured to move vertically upwardly and downwardly within a hoistway 12 along a plurality of car guide rails (not shown). Guide assemblies mounted to the top and bottom of the elevator car 14 are configured to engage the car guide rails to maintain proper alignment of the elevator car 14 as it moves within the hoistway 12.

The elevator system 10 also includes a counterweight 16 configured to move vertically upwardly and downwardly within the hoistway 12. The counterweight 16 moves in a direction generally opposite the movement of the elevator car 14 as is known in conventional elevator systems. Movement of the counterweight 16 is guided by counterweight guide rails (not shown) mounted within the hoistway 12. In the illustrated, non-limiting embodiment, at least one load bearing member 30 coupled to both the elevator car 14 and the counterweight 16 cooperates with a traction sheave 18 mounted to a drive machine 20. To cooperate with the traction sheave 18, at least one load bearing member 30 bends in a first direction about the traction sheave 18. In one embodiment, any additional bends formed in the at least one load bearing member 18 must also be in the same first direction.

The drive machine 20 of the elevator system 10 is positioned and supported at a mounting location atop a support member 22, such as a bedplate for example, in a portion of the hoistway 12 or a machine room. Although the elevator system 10 illustrated and described herein has a 1:1 roping configuration, elevator systems 10 having other roping configurations and hoistway layouts are within the scope of the invention. In embodiments having alternative roping configurations, a twist may be arranged in the load bearing members 30, as known in the art, to avoid reverse bends or other arrangements where all bending of the load bearing members 30 occurs in the same direction.

Figure 2:
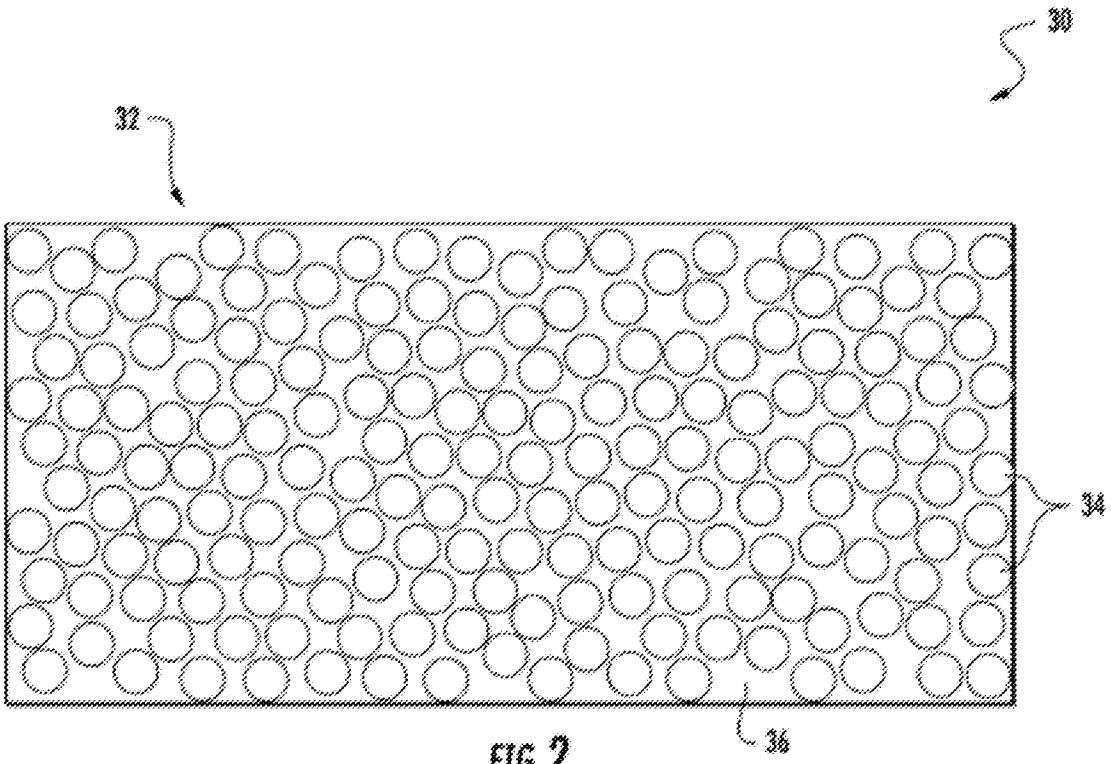
FIG. 2 is a cross-sectional view of a load bearing member that would be included in a load bearing belt according to an embodiment of the invention.
Figure 3:
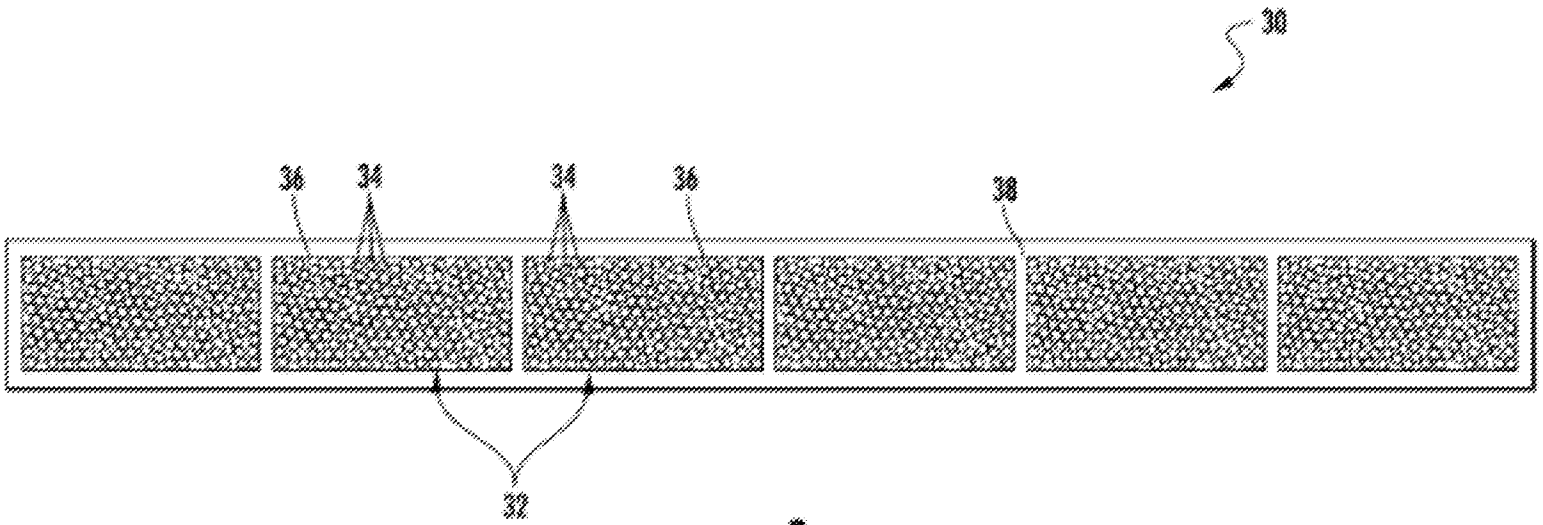
FIG. 3 is a cross-sectional view of a load bearing belt having a plurality of load bearing segments interconnected by a coating layer according to an embodiment of the invention.

Referring now to FIGS. 2-3, a cross-section of an example of a load bearing member 30 according to an embodiment of the invention is illustrated in more detail. In the illustrated, non-limiting embodiment of FIG. 2, the load bearing member 30 includes a single tension member or load bearing segment 32 having a plurality of individual load carrying fibers 34 arranged unidirectionally within a rigid matrix material 36. The load bearing segment 32 may have a cross-section of any shape. As shown in the illustrated, non-limiting embodiment, the load carrying fibers 34 within the load bearing segment 32 are randomly distributed throughout the matrix material 36; however, a density of the load carrying fibers 34 across the area of the load bearing segment 32 remains nominally uniform. In other embodiments, however, the density of the fibers 34 may be non-uniform such that the load bearing segment 32 may have other desired properties.

Exemplary load bearing fibers 34 used to form a load bearing segment 32 include, but are not limited to, carbon, glass, aramid, nylon, and polymer fibers for example. Each of the fibers 34 within a single load bearing segment 32 may be substantially identical or may vary. In addition, the matrix material 36 may be formed from any suitable material, such as polyurethane, vinylester, and epoxy for example. The materials of the fibers 34 and matrix material 36 are selected to achieve a desired stiffness and strength of the load bearing member 30.

In another embodiment, the load bearing member 30 may include a plurality of load bearing segments 32. The segments 32 are generally the same length and may have substantially identical configurations, or may vary in one or more of size, shape, material, etc. As shown in FIG. 3, the plurality of load bearing segments 32 may be generally separated from one another by a distance. In the illustrated, non-limiting embodiment, the plurality of load bearing segments 32 are encased with a jacket or coating layer 38 to restrain movement of the load bearing segments 32 relative to one another and protect the load bearing segments 32 from impact. However, it should be understood that any load bearing member 30 may include a coating layer 38 including embodiments having only a single load bearing segment 32.

In embodiments including a coating layer 38, the coating layer 38 defines an engagement surface configured to contact a corresponding surface of the traction sheave 18. Suggested materials for the coating layer 38 include the elastomers of thermoplastic and thermosetting polyurethanes, polyaramid, and rubber for example. Other materials may be used to form the coating layer 38 if they are adequate to meet the required functions of the load bearing member 30. For example, a primary function of the coating layer 38 is to provide a sufficient coefficient of friction between the load bearing member 30 and the traction sheave 18 to produce a desired amount of traction there between. The coating layer 38 should also transmit the traction loads to at least one load bearing segments 32. In addition, the coating layer 38 should be wear resistant and protect the one or more segments 32 from impact damage, exposure to environmental factors, such as chemicals for example, or more importantly, may provide a means for making the load bearing member 30 flame retardant.

Figure 4B:
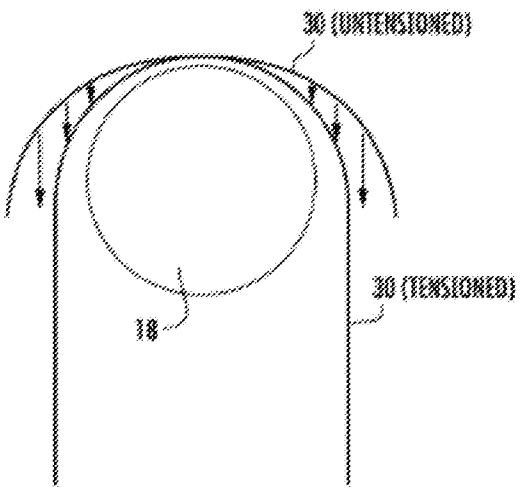
FIG. 4*b* is a side view of a load bearing member according to an embodiment of the invention in an untensioned and tensioned configuration.
Figure 4A:
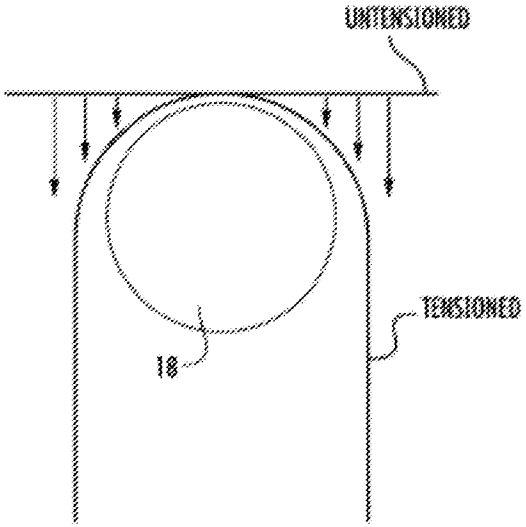
FIG. 4A Prior Art
FIG. 4*a* is a side view of a conventional load bearing member in an untensioned and tensioned configuration.

As previously described, the load bearing member 30 is configured to wrap at least partially around the traction sheave 18. In one embodiment, the traction sheave 18 has a diameter between 150 and 300 times the thickness of the load bearing member 30. With reference now to FIG. 4*b*, the load bearing member 30 is formed to include a radius of curvature when untensioned. The curvature of the load bearing member 30 when untensioned may have a diameter between about 1.5 to about 2.5 times the diameter of the traction sheave 18. As is clearly illustrated in FIGS. 4*a* and 4*b*, the distance that a load bearing member 30 having a radius of curvature must bend around a sheave 18 when tension is applied thereto is significantly less than the distance that a conventional linear load bearing member 30 must bend around a sheave 18 when tension is applied thereto. As a result, the bending stress experienced by a load bearing member 30 having a radius of curvature is significantly reduced, thereby improving the load bearing capacity and life of the load bearing member 30.

Figure 5:
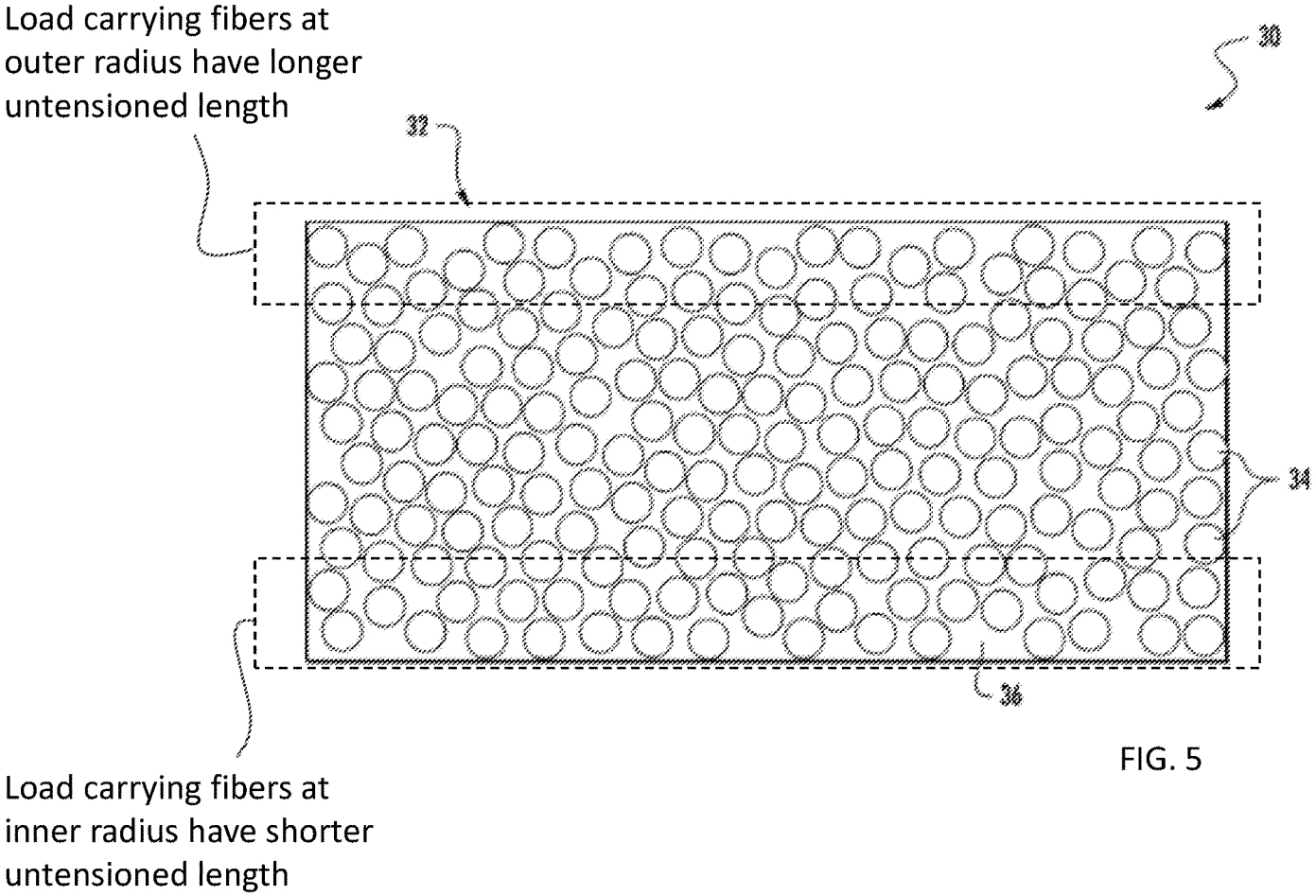
FIG. 5 is a cross-sectional view of a load bearing member that would be included in a load bearing belt according to an embodiment of the invention.

In other embodiments, only a portion of the load bearing member 30, such as the drive portion configured to contact the traction sheave 18 for example, includes a radius of curvature when the load bearing member 30 is untensioned. As a result of forming the load bearing member 30 with a radius of curvature, the circumferential length of the load carrying fibers 34 may vary. For example, with reference to FIG. 5, the load carry fibers arranged on the outside of the curvature generally have a first unstressed length, and the length load carrying fibers 34 arranged adjacent the inside of the curvature would have a second unstressed length, shorter than the first unstressed length. By having the length of the fibers 34 generally decrease from the outside to the inside of the curvature, internal stresses of the load carrying member 30 may be eliminated.

The one or more load bearing segments 32 of the load bearing member 30 may be fabricated by a pultrusion process. In a standard pultrusion process, the fibers are impregnated with a matrix material and are pulled through a heated die and additional curing heaters where the matrix undergoes cross linking. A person having ordinary skill in the art will understand that controlled movement and support of the pulled fibers may be used to form a desired linear or curved profile of the untensioned load bearing member 30.

By forming the composite load bearing member 30 with an initial curvature, the bending stress of the load bearing member is reduced for a given thickness. Consequently, the thickness of the load bearing member 30 may be increased, thereby increasing the load carrying capability per unit width, before reaching a maximum allowable bending stress. In addition, during the packaging and shipment of a load bearing member 30 formed with an initial curvature, the stored energy of the coiled load bearing member 30 is lowered, thereby reducing the requirements of the shipping containers.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A load bearing member, comprising:

at least one load bearing segment including a plurality of load carrying fibers arranged within a matrix material, wherein at least a portion of the load bearing member has a radius of curvature when the load bearing member is untensioned, and wherein an untensioned length of the plurality of load carrying fibers arranged within the portion of the load bearing member having a radius of curvature that varies.

2. The load bearing member according to claim 1, wherein the plurality of load carrying fibers have a unidirectional orientation.

3. The load bearing member according to claim 1, wherein the plurality of load carrying fibers are substantially identical.

4. The load bearing member according to claim 1, wherein the plurality of load carrying fibers arranged at an outer portion of the radius of curvature have a longer untensioned length than a plurality of load bearing fibers arranged adjacent to an inside of the radius of curvature.

5. The load bearing member according to claim 1, wherein the at least one load bearing segment is formed as a pultrusion.

6. The load bearing member according to claim 1, wherein the load bearing member includes a plurality of load bearing segments spaced apart from one another by a distance.

7. The load bearing member according to claim 6, wherein each of the plurality of load bearing segments is substantially identical.

8. The load bearing member according to claim 1, wherein a coating layer surrounds at least a portion of the at least one load bearing segment and defines an engagement surface of the load bearing member.

9. An elevator system, comprising:

a hoistway;

a drive machine mounted within the hoistway, the drive machine having a traction sheave coupled thereto an elevator car movable within the hoistway;

a counterweight movable within the hoistway;

at least one load bearing member connecting the elevator car and the counterweight, the load bearing member being arranged in contact with the traction sheave such that operation of the drive machine moves the elevator car between a plurality of landings, the at least one load bearing member including:

at least one load bearing segment including a plurality of load carrying fibers arranged within a matrix material, wherein at least a portion of the load bearing member has a radius of curvature when the load bearing member is untensioned and wherein an untensioned length of the plurality of load carrying fibers arranged within the portion of the load bearing member having a radius of curvature that varies.

10. The elevator system according to claim 9, wherein the traction sheave has a diameter between about 150 and 300 times a thickness of the load bearing member.

11. The elevator system according to claim 9, wherein the plurality of load carrying fibers have a unidirectional orientation.

12. The elevator system according to claim 9, wherein the plurality of load carrying fibers arranged adjacent an inner bend radius have a first untensioned length and the plurality of load carrying fibers arranged adjacent an outer bend radius have a second untensioned length, the first untensioned length being shorter than the second untensioned length.

13. The elevator system according to claim 9, wherein the at least one load bearing segment is formed as a pultrusion.

14. The elevator system according to claim 9, wherein the load bearing member includes a plurality of load bearing segments spaced apart from one another by a distance.

15. The elevator system according to claim 14, wherein each of the plurality of load bearing segments is substantially identical.

16. The elevator system according to claim 9, wherein the load bearing member includes a coating layer surrounding a portion of the at least one load bearing segment, the coating layer defining an engagement surface configured to contact the traction sheave.

17. The elevator system according to claim 9, wherein the curvature of the load bearing member when untensioned has a diameter between about 1.5 to about 2.5 time a diameter of the traction sheave.

* * * * *